US010342113B2

(12) United States Patent
Kock et al.

(10) Patent No.: US 10,342,113 B2
(45) Date of Patent: Jul. 2, 2019

(54) CONTROLLED LASER IRRADIATION ATOM SOURCE

(71) Applicant: The University of Birmingham, Birmingham (GB)

(72) Inventors: Ole Kock, Birmingham (GB); Yeshpal Singh, Birmingham (GB); Kai Bongs, Birmingham (GB); Wei He, Birmingham (GB)

(73) Assignee: THE UNIVERSITY OF BIRMINGHAM, Birmingham (GB)

( * ) Notice: Subject to any disclaimer, the term of this patent is extended or adjusted under 35 U.S.C. 154(b) by 0 days.

(21) Appl. No.: 15/128,731

(22) PCT Filed: Mar. 24, 2015

(86) PCT No.: PCT/GB2015/050876
§ 371 (c)(1),
(2) Date: Sep. 23, 2016

(87) PCT Pub. No.: WO2015/145136
PCT Pub. Date: Oct. 1, 2015

(65) Prior Publication Data

US 2017/0105276 A1 Apr. 13, 2017

(30) Foreign Application Priority Data

Mar. 24, 2014 (GB) ..... 1405258.3
Jun. 2, 2014 (GB) ..... 1409734.9

(51) Int. Cl.
*H05H 3/02* (2006.01)
*H05H 3/00* (2006.01)
*G04F 5/14* (2006.01)

(52) U.S. Cl.
CPC ..... *H05H 3/02* (2013.01); *G04F 5/14* (2013.01); *H05H 3/00* (2013.01); *G04F 5/145* (2013.01)

(58) Field of Classification Search
None
See application file for complete search history.

(56) References Cited

U.S. PATENT DOCUMENTS 5,032,375 A * 7/1991 Lerot ..... C01G 23/006 423/598
2009/0272893 A1* 11/2009 Hieftje ..... H01J 49/0463 250/282

FOREIGN PATENT DOCUMENTS

KR 20030051485 6/2003

OTHER PUBLICATIONS

Leibrandt et al. "Laser ablation loading of a surface-electrode ion trap", Physical Review A 76 (2007).*
Balazs "Expansion of Laser-Generated Plumes Near the Plasma Ignition Threshold" Anal. Chem. 63 (1991).*
Hendricks et al. "An all-optical ion-loading technique for scalable microtrap architectures" Appl. Phys. B 88 (2007).*
Written Opinion dated Dec. 3, 2015 in Application No. PCT/GB2015/050876.

(Continued)

*Primary Examiner* — James Choi
(74) *Attorney, Agent, or Firm* — Snell & Wilmer L.L.P.

(57) ABSTRACT

A method of generating at least one trapped atom of a specific species, the method comprising the steps of: positioning a sample material (18) comprising a specific species in a vacuum (14); generate an atomic vapor (20) of the specific species by irradiating the sample material with a first laser (12); trapping one or more atoms from the generated atomic vapor.

14 Claims, 4 Drawing Sheets

(56) References Cited

OTHER PUBLICATIONS

International Search Report dated Dec. 3, 2015 in Application No. PCT/GB2015/050876.
Hendricks, et al., "An all-optical ion-loading technique for scalable microtrap architectures," Applied Physics B—Lasers and Optics, Springer, Berlin, Germany, vol. 88, No. 4, Jun. 2007, pp. 507-513.
Zimmerman, et al., "Laser ablation loading of a radiofrequency ion trap," Applied Physics; Lasers and Optics, Springer, Berlin, Germany, vol. 107, No. 4, Feb. 2012, pp. 1-6.
Leibrandt, et al., "Laser ablation loading of a surface-electrode ion trap," arxiv.org, Cornell University Library, Ithaca, New York, Jun. 2007, pp. 1-4.
Klempt, et al., "Ultraviolet light-induced atom desorption for large rubidium and potassium magneto-optical traps," Physical Review, vol. 73, No. 1, Jan. 2006, pp. 1-8.
Mimoun, et al., "Fast production of ultracold sodium gases using light-induced desorption and optical trapping," Physical Review, vol. 81, No. 2, Feb. 2010, pp. 1-8.
Kawalec, et al., "Dynamics of laser-induced cesium atom desorption from porous glass," Chemical Physics Letters 120, Elsevier BV, Netherlands, vol. 42, No. 4-6, Mar. 2006, pp. 291-295.
Schiller, et al., "The space optical clocks project: Development of high-performance transportable and breadboard optical clocks and advanced subsystems," European Frequency and Time Forum, Apr. 2012, pp. 1-5.
Hutzler, et al., "The Buffer Gas Beam: An Intense Cole, and Slow Source for Atoms and Molecules," arvix.org, Cornell University Library, Ithaca, New York, Nov. 2011, pp. 1-30.
Combined Search and Examination Report dated Jan. 30, 2015 in Application No. GB1409734.9.

* cited by examiner

CONTROLLED LASER IRRADIATION ATOM SOURCE

CROSS-REFERENCE TO RELATED APPLICATIONS

This application is a U.S. national phase filing under 35 U.S.C. § 371 of PCT/GB2015/050876 filed Mar. 24, 2015. PCT/GB2015/050876 claims priority from GB Application No. 1405258.3 which was filed on Mar. 24, 2014, and GB Application No. 1409734.9 which was filed on Jun. 2, 2014. All of the aforementioned applications are incorporated herein by reference in their entirety.

FIELD OF INVENTION

The present invention relates to a method and apparatus for producing a controlled atom source, in particular for cold atom applications.

BACKGROUND TO THE INVENTION

The ability to produce a vapour of trappable atoms of a specific atomic species is useful for cold atom apparatus such as those that involve an atomic vapour source being subjected to laser cooling under vacuum. Such apparatus include those where atoms are captured from a background gas, or a beam of atoms, under vacuum.

There are many desirable practical applications that require the use of a source of trappable atomic vapour of specific atoms. For example, a source of atomic vapour of specific atoms is desirable for the production of optical clocks (which use laser cooled atoms) and atom-interferometers (which can be used as gravity sensors or gravity gradient sensors). Additionally, a source of atomic vapours is desirable for experiments with Bose-Einstein-Condensates.

A known method for generating an atomic vapour of trappable atoms, is to use a material which has a sufficient vapour pressure at room temperature, and placing a bulk sample of that material in a vacuum chamber. The supply of atomic vapour is then controlled through the use of a valve between a source and an experimental vacuum chamber. However, this method of generation of atomic vapours cannot be used if the materials which contain the desired atomic species has a negligible vapour pressure at ambient temperature.

A more versatile for generating an atomic vapour of trappable atoms for a greater range of atomic species involves heating a bulk sample of a desired atomic species in an oven or a dispenser, thereby to produce the necessary thermal energy to cause the material to evaporate or sublime into a vacuum chamber. However since ovens intrinsically produce heat, use of ovens with cold atom devices is inherently problematic and may lead to the device being large in size in order to separate the heat source (and consequent background radiation) from parts of the devices where a low temperature is needed. For example with atomic clocks heat can produce associated shifts of the atomic lines and therefore of the clock or frequency output. Consequently optical clocks which use an oven to produce an atomic vapour are relatively large and they also lack fine control.

The known methods for generating atomic vapours, as described above, can be difficult to control, which can prove especially problematic when performing detailed and accurate experiments or processes. In the prior art, in order to address this problem, it is known to achieve higher control when generating atomic vapours in a multi-chamber setup through the use of light induced atomic desorption (LIAD), whereby atoms that have stuck to the inside walls of a vacuum chamber are encouraged to desorb by shining light onto the vacuum chamber walls. In such circumstances, the adsorbed atoms may be sparsely or sporadically distributed, therefore introducing an element of uncertainty into the process, whereby the location and density of atoms may not fulfil the requirements of the application that uses the atomic vapour. However LIAD is only suitable for use with some atomic species and requires intermediate equipment, in addition to the oven or other apparatus used to initially produce an atomic vapour, thereby increasing the size and complexity of the devices.

For some cold atom devices and applications, including optical clocks, atoms for alkaline earth metals such as strontium are desirable. LIAD has not presently been found effective with these atoms. Ovens are conventionally used, causing difficulties with background heat radiation. The difficulty in producing atomic vapours by thermally heating a bulk sample, such as a metal, becomes even more difficult when the material has reacted to form a more stable compound (for example, the melting/boiling point and energy of melting/vaporization is significantly higher for of strontium oxide than for strontium). The temperature required to cause a phase transition in such materials is very high and would result in too much thermal energy being present in a system for processes that require cold atoms.

In addition to applications using cold atoms, a reliable and controllable source of atomic vapour of a specific species can desirable as a thermal source of atoms, whereby the thermal atoms can be used at least in the following exemplary fields: magnetometry (which has application in the field of medical sciences, for example, where thermal atoms might be used to perform experiments such as brain mapping); surface science (using the emitted atoms to coat surfaces); ion physics (for example in Ion Atom collision physics, where one can measure scattering cross sections, charge transfer cross sections etc. in an Ion-Atom collision); bio sciences (exploring the interaction between alkali atoms (Sr, Yb, Mg . . . ) and large bio molecules, including DNA and other molecules, whereby Strontium (Sr) ions, for example, can interact with a bio molecule via sharing/transfer of electron/s to the Sr ion, which might result in a bond, or just charge transfer); chemistry (for example, the formation of molecules including the ultra-cold molecules and the control of a reaction at the quantum level in particular in ultra-cold molecules); and nano technology (for example, to create atomic level structures on a substrate, perhaps in combination with laser cooling techniques).

Atoms can be separated from a bulk sample by "laser ablation" with a laser being directed on bulk samples themselves (as opposed to the adsorbed atoms addressed with LIAD). Laser ablation of this nature is likely to produce too much heat in order to make it a good method for producing trappable atoms for laser cooling. Conventional laser ablation techniques often result in the atoms forming a plasma and so may not be useful for all applications.

A most common mechanism used by laser ablation to separate atoms from the sample is to provide enough energy to locally heat the sample to generate sufficient thermal energy to evaporate or sublimate to form an atomic vapour by heating. Consequently these techniques rely on thermal energy and suffer from at least some of the disadvantages of an oven. An alternative laser ablation technique using femtosecond pulses separates atoms by ionisation, producing high energy free electron that pull the ions out of the sample by electrostatic forces. These femtosecond techniques require very high power pulses and sufficient time gaps between the pulses, affecting controllability and velocity of the atoms in the vapour.

In order to mitigate for at least some of the above problems and disadvantages according to the present invention, there is provided methods and apparatus as claimed in the attached claims.

BRIEF DESCRIPTION OF THE FIGURES

Embodiments of the invention are now described, by way of example only, with reference to the accompanying drawings in which.

DETAILED DESCRIPTION OF AN EMBODIMENT

In order to generate an atomic vapour of a specific atomic species without generating any significant heat, an apparatus and method are described here.

Figure 1:
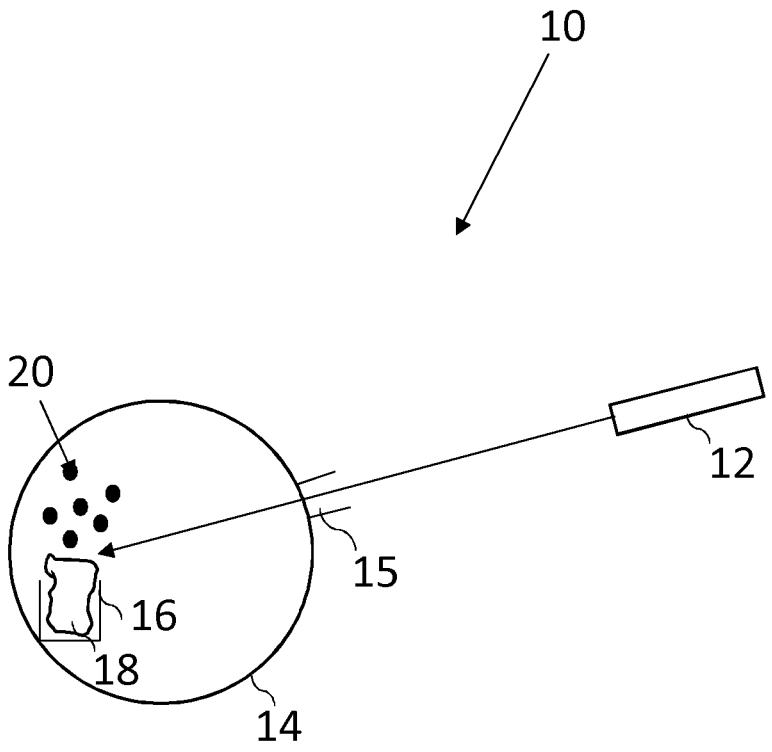
FIG. 1 is a schematic illustration of apparatus for producing an atomic vapour.

FIG. 1 shows an apparatus 10 that is used to generate an atomic vapour of a specific species 20. There is shown a vacuum chamber 14, in which the atomic vapour of a species 20 is desirably generated. The vacuum chamber 14 is connected to one or more vacuum pumps (not shown). The pressure in the vacuum chamber 14 is measured using a pressure gauge (not shown).

A sample material 18 comprising the atomic species that is to be used to generate the atomic vapour 20 is placed in a container 16 in the vacuum chamber 14. The vacuum chamber 14 is evacuated until a sufficiently high vacuum has been established. Once a sufficiently high vacuum has been established in the vacuum chamber 14, a laser source 12 is used to direct light on to the surface of the sample 18. The frequency and intensity of the laser source 12 are determined such that, in use, an atomic vapour 20 is generated.

The laser source 12 is situated outside of the vacuum chamber 14 and the laser light from the laser source 12 is directed into the vacuum chamber 14 through a sufficiently optically transparent window 15. When the laser source 12 is shining light upon the sample material 18, an atomic vapour of a specific species 20 is produced. When the laser source 12 is not shining light upon the bulk material 18, no atomic vapour of a specific species 20 is produced. The amount of atomic vapour 20 that is produced is a function of the flux of light emitted by the laser source 12. The amount of atomic vapour 20 that is produced is controllable by altering the flux of light that is incident on the sample 18. This can be controlled by altering the number of photons from the laser. The amount of vapour produced form any given area of the sample may also be changed by altering the total area of the sample onto which the laser energy is concentrated.

The laser light from the laser source 12 has a frequency higher than a frequency found to be required to break the bonds of the sample material 18 in order to generate an atomic vapour 20.

Preferably the laser light from the laser source 12 generates relatively little local heating in the sample. Surprisingly it has been found that by correct selection of laser frequency and selection and/or treatment of the sample, an atomic vapour can be produced with less energy than is required to evaporate or sublimate the sample material 18 by heating. If the laser intensity is too high, the process will be dominated by the production of thermal energy (due to photon absorption at defects, phonon generation etc.), causing the sample material 18 to melt and evaporate, or to directly sublimate. This can produced an atomic vapour but the background heat radiation may cause difficulties for some applications and lead to less controllability.

It has been found that the selection and/or treatment of sample that produces good results may be significantly different to selections that would be made to provide vaporization by heat. For example whilst the metallic bonding of a sample material 18 that is a metal may require a relatively lower thermal energy to produce an atomic vapour, a more stable compound, such as an oxidised metal sample material 18 would usually require a relatively higher thermal energy in order to evaporate or directly sublimate the material. Consequently oxidised metal samples would conventionally be considered less suitable as samples to provide a vapour of the metal atoms. However, with the current invention is has been found that intermediate compounds of the desired species, including oxides with higher melting points than the bulk metal, can be advantageous. It is preferable to generate little thermal energy and is possible to generate less thermal energy than is required to evaporate or sublimate the sample material 18 and instead rely on other mechanisms to generate the atomic vapour 20. It is believed that the current invention can break molecular bonds of the intermediate compound thereby realising the atoms of the desired species.

The apparatus 10 is connected in the form of a source to another apparatus (not shown), which may be one of an optical clock, atom interferometer or apparatus for a Bose-Einstein Condensate experiment.

Figure 2:
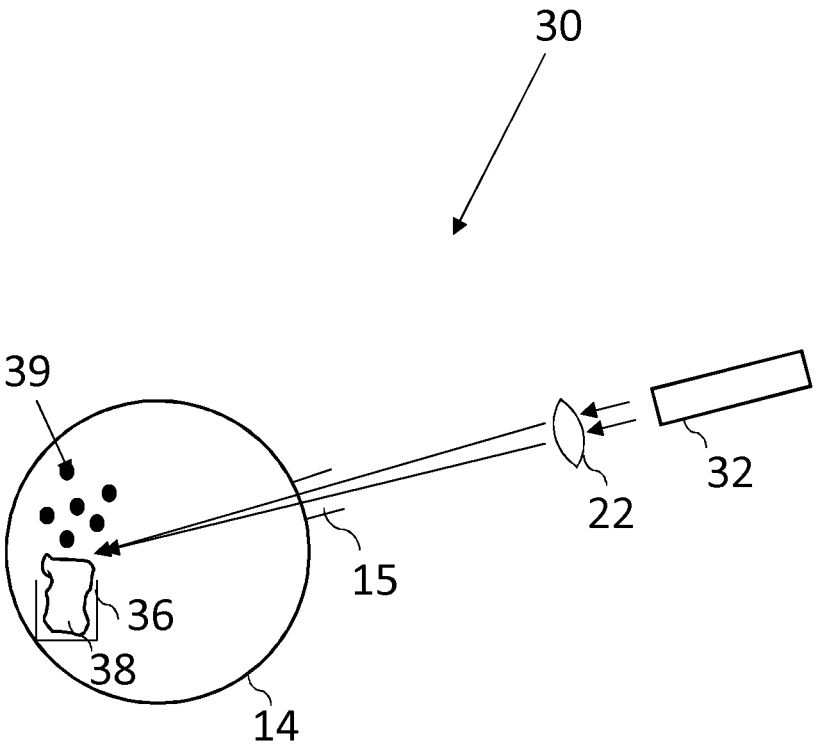
FIG. 2 is a schematic illustration of apparatus for producing an atomic vapour of strontium atoms

An example of the above apparatus and method are now described in relation to the generation of an atomic vapour of strontium, with reference to FIG. 2. An atomic vapour of strontium can be used as part of an optical clock, atom interferometer, or as part of a Bose-Einstein Condensate experiment (not shown).

FIG. 2 shows an apparatus 30 that is used to generate an atomic vapour of strontium 39. There is shown a vacuum chamber 14, in which the atomic vapour of strontium 39 is desirably generated.

A bulk sample comprising strontium 38 is prepared and inserted into the vacuum chamber 14. In order to prepare the sample 38, pure strontium is left to oxidise in air, thereby forming a layer of strontium oxide, prior to being placed in a crucible 36 in the vacuum chamber 14. A typical bulk sample of strontium would be a piece of granular strontium (99% trace metals basis, under oil), of the order of a few cubic millimeters. The strontium is cleaned with solvents including acetone and isopropanol in order to remove the oil film. Subsequently, the strontium is exposed to air for several hours in order to react and produce a layer of strontium oxide. The strontium oxide, which may be a different colour to the naked eye, when compared with pure strontium metal, is then placed in a vacuum chamber 14.

The vacuum chamber 14 is evacuated until a sufficiently high vacuum has been established. A vacuum of the order of $10^{-8}$ mbar, or better is suitable. Once a sufficiently high vacuum has been established in the vacuum chamber 14, a laser diode 32 is used to irradiate the surface of the oxidised bulk sample of strontium 38.

The laser diode 32 is situated outside of the vacuum chamber 14 at a distance of approximately 10 cm from the oxidised bulk sample of strontium 38 and the light is directed into the vacuum chamber 14 through a sufficiently optically transparent window 15. The laser light from the laser diode 32 is focused through lens 22 onto the oxidised bulk sample of strontium 38. When the laser diode 32 is shining light upon the bulk material 18, an atomic vapour of a strontium 39 is produced, when the intensity of the laser beam is sufficient. When the laser diode 32 is not shining light upon the bulk material 38, or the laser intensity is insufficient, no atomic vapour of strontium 39 is produced. The amount of atomic vapour 39 that is produced is a function of the flux of light emitted by the laser diode 32. The amount of atomic vapour 39 that is produced is controllable by altering the power of the laser 12 that is incident on the bulk sample 38.

The laser diode 32 produces light at a wavelength of 405 nm. Alternatively other wavelengths of light may be used to achieve the same effect. In particular different wavelength may be used for different sample materials.

The lens 22 is an acrylic lens, with a focal length of 4 mm. The lens 22 is placed outside the vacuum chamber 14 but closer to the sample 18 than the laser 12 is. Laser 12 generates a beam about 2 mm in diameter and the lens is used to focus the laser onto a spot sixe of about 50-100 micrometers. Focussing with a lens in this manner produces a suitable intensity of vapour from a suitable sized area so that the vapour rate can be controlled and optimised, but the lens and focussing steps are not necessary to produce a vapour. In further examples, lens 22 is made from any suitable material for focusing the laser beam in a usable manner.

As illustrated in FIG. 2, the laser diode 32 is outside of the vacuum chamber 14, thereby providing access to the laser diode 32 in order to position and align it and its generated light in a way necessary to generate the atomic vapour 39. However, alternatively, the laser diode 32 can be inside the vacuum chamber 14, therefore reducing any attenuation through an optical window and allowing the laser diode to be positioned more directly next to the bulk sample 39.

The intensity of light from the laser diode 32 can be controlled by altering the laser power and pulse duration of the laser diode 32. Laser power ranges between approximately 7 mW and 70 mW provides good results and typically, a laser power is of the order of 10 mW is used in order to generate a manageable amount of strontium atoms. Beneficially a continuous wave laser 12 can be used rather than a pulsed laser.

The distances between the oxidised bulk sample of strontium 38, the lens 22 and the laser diode 32 can be altered in order to maximise the efficiency with which an atomic vapour of strontium 39 is produced from any given area of the sample.

A different metal to strontium can be used, such as beryllium, magnesium, calcium, barium or radium (alkaline earth metals), ytterbium or alkali metals, thereby to generate a different atomic vapour 39 comprising the alkaline earth metal, ytterbium or alkali metal. The sample material 38 can be an oxide or hydroxide of that metal, or earth metal.

In the above example with reference to FIG. 2, a bulk sample comprising strontium 38 is described. However, as noted above, the sample material 38 can be an oxide of a metal or an Earth metal. In order to produce more continuous and or stable strontium emission, it can be beneficial to use strontium oxide powder as the sample material 38. In one effective method strontium oxide sample can be prepared by mixing strontium oxide powder with acetone to form a paste. The paste is then dried in a dish, creating a thin film. Acetone is used as a solvent because it evaporates quickly from its liquid form to its gaseous form, under normal ambient conditions, so that a dry powder thin film is formed in the dish before the thin film is placed into a vacuum where it is subsequently irradiated with a laser. Therefore the residual thin film of strontium oxide powder does not contain acetone, prior to the subsequent introduction of the strontium oxide powder to the vacuum chamber 14.

In order to prepare the paste, a ratio of volume of approximately 1:1 acetone:strontium can be used to prepare the paste. Using approximately 100 mg of strontium oxide to cover a surface of approximately 5 $cm^2$ provides a thin layer of strontium oxide that has been found to offer a particularly consistent subsequent laser induced strontium evaporation.

Strontium oxide powder, such as Alfa Aesar 88220 grade product is suitable for the purpose of the above process. The strontium oxide powder is 100 mesh particle size. Optionally, the strontium oxide powder is ground using a device, such as a pestle and mortar, in order to reduce the particle size further. The strontium oxide powder particles may therefore be optimally provided in a range from approximately 5 to 150 microns. However, other strontium oxide particle sizes may be provided to produce similar effects.

Whilst acetone may be used as a solvent to produce a paste for forming a thin layer of strontium oxide powder, other solvents could also be used. Preferably the solvent is removed before the sample is introduced into the vacuum chamber, thereby avoiding contamination of the vacuum equipment with the solvent. The solvent may be removed from the paste by leaving the paste under ambient conditions, where the temperature of the surroundings will cause the solvent to evaporate at room temperature and therefore be removed from the paste, leaving a residual, dry, thin film of powder. By changing the solvent, the parameters for removing the solvent from the paste will vary, for example a different ambient temperature or methodology may be required to remove the solvent from the paste, prior to the dry thin film of powder being introduced into the vacuum chamber, where the dry thin film is irradiated with a laser.

The process for preparing a thin film of the sample material 38 can be applied to different metals to strontium, such as beryllium, magnesium, calcium, barium or radium (alkaline earth metals), ytterbium or alkali metals, thereby to generate a different atomic vapour 39 comprising the alkaline earth metal, ytterbium or alkali metal. The sample material 38 can be an oxide or hydroxide of that metal, or earth metal.

Figure 3:
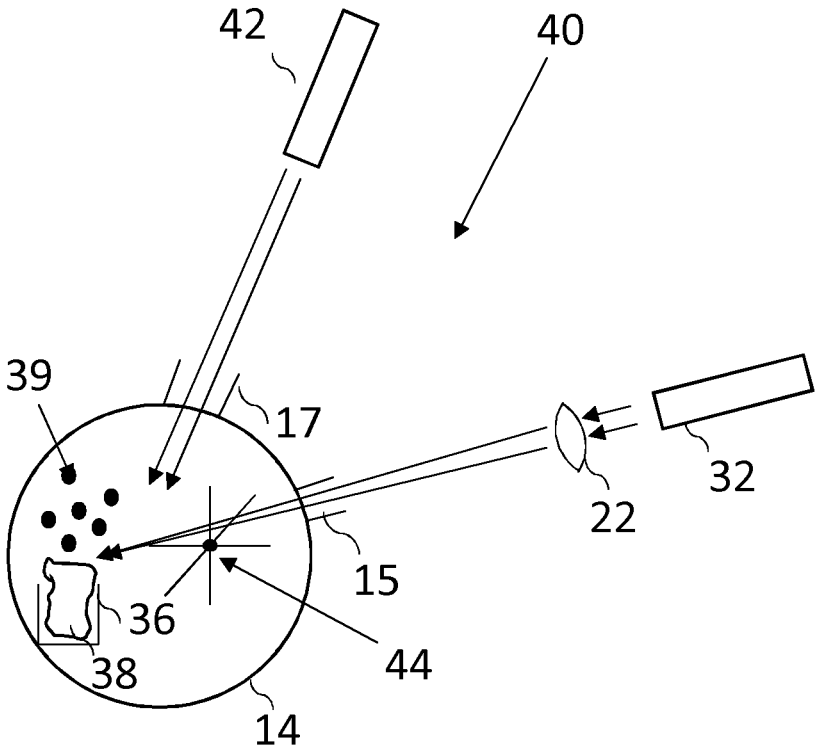
FIG. 3 is a schematic illustration of apparatus for generating and measuring an atomic vapour of strontium atoms.

FIG. 3 shows an apparatus 40 used to generate, detect and measure strontium atoms in an atomic vapour. This appears is not required to make use of the atomic vapour (e.g. it is not required for use of the vapour in an optical clock) but can been used to measure results and may therefore be used to measure the effects of adjusting the parameters in order to obtain the most suitable results for any given application and/or sample material.

The apparatus is as described in relation to FIG. 2, with the application of two further elements.

Firstly, resonant laser 42 is used to direct a laser beam into the vacuum chamber 14 through a second optical window 17. The resonant laser beam operates at 460.8 nm and when atoms of strontium pass through the beam, a strong fluorescence is observed, thereby confirming the presence of strontium atoms. The resonant laser beam is of the order of 1 mm in diameter and has a power of 1 to 5 mW.

Secondly, a magneto optical trap (MOT) 44 (represented by three lines, indicative of the three orthogonal laser beams that are used to trap strontium atoms), is shown, which MOT 44 is used to cool individual strontium atoms. The three laser beams of the MOT 44 are retro-reflected circular polarised beams of 10 mW power and with diameters of the order of 1.5 cm and the MOT 44 further comprises a magnetic quadrupole field with a magnetic field gradient of approximately 35 G/cm.

Atomic strontium vapour 39 produced using the parameters described in accordance with FIG. 2 yields atoms with sufficiently low velocity (typically less than 50 meters per second) to be trapped by the MOT 44. When the laser diode 32 irradiates the oxidised bulk sample of strontium 38 with a power higher than a threshold, laser cooled atoms of strontium can be detected in the MOT 44.

In further examples, the wavelength of the resonant laser 42 is adapted to detect a different atomic vapour. Examples of compounds that can be used to generate atomic vapours for optical clock devices include the oxide and hydroxides of alkaline earth metals.

Figure 4:
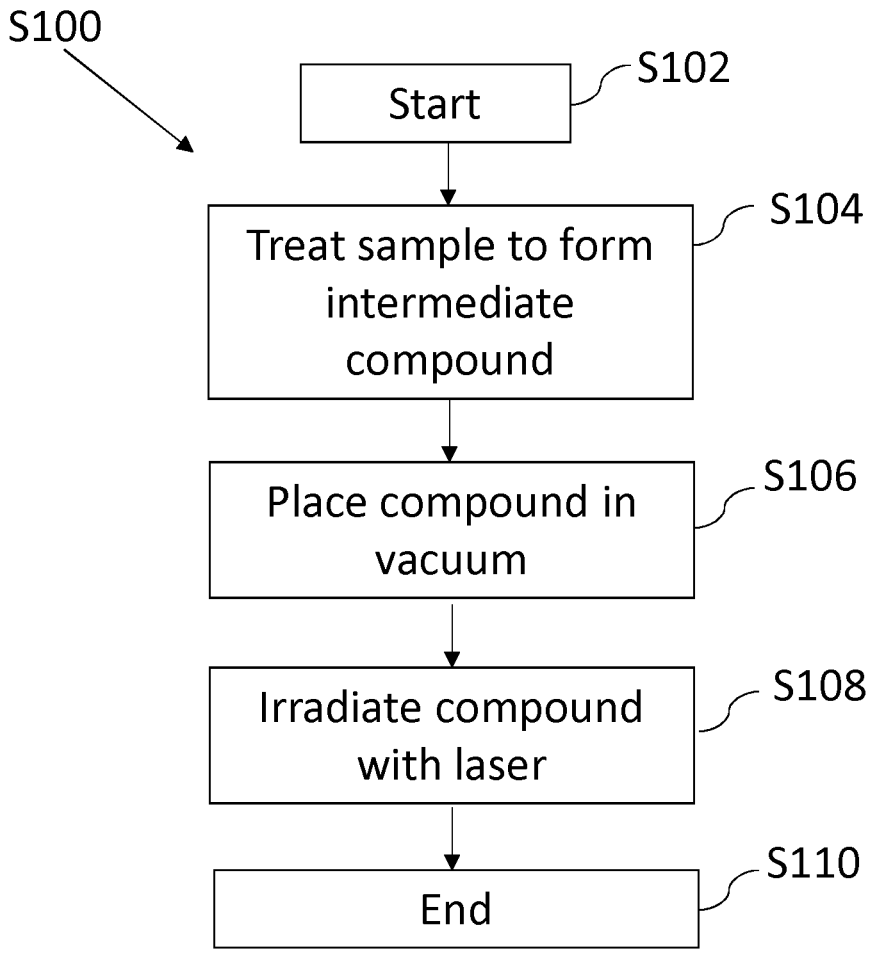
FIG. 4 is a flow chart of a process of generating an atomic vapour from an intermediate compound such an oxide.

FIG. 4 is a flowchart S100 showing the stages of atomic vapour generation according to an embodiment of the invention. The method can be performed using the apparatus 10, 30, 40, described in relation to any of the preceding figures.

The process starts at step S102 by selection of the material that is to be used to produce the atomic vapour. This is the material of the specific species that is desired to be produced in the form of an atomic vapour. The material that is to be used can be a material with a vapour pressure at room temperature that is insufficient to generate atomic vapour, such as a metal.

The material is treated in order to form an intermediate compound at step S104. For example, a metal can be oxidised, or subjected to conditions (atmosphere/temperature) that are conducive to producing an intermediate compound comprising the specific species that is required to form the atomic vapour. The treatment, for example the oxidation of a metal, may be instigated by either exposing the metal to air, or by heating it in air. The material is treated until a sufficient amount of the oxidised sample has been produced to generate an atomic vapour of sufficient quantity for the application at hand. Once the material has been prepared, the process moves to step S106.

At step S106, the sample compound is placed in an ultra-high vacuum chamber which is pumped out until a sufficient pressure is reached. The compound sample can then be irradiated with a laser beam at step S108.

The irradiated of the compound with a laser at step S108 causes bonds of the compound to break and release the atoms in an atomic vapour of a specific species. This method is particularly advantageous when the partial pressure of the desired specific species is insufficient to ordinarily generate an atomic vapour of the specific species without heating the sample.

Preferably a pure material of the specific species required to produce an atomic vapour is treated at step S104. However, in further examples, this step may be dispensed with and a suitable compound comprising the specific species required in the form of an atomic vapour may be prepared or sourced directly and placed in the vacuum chamber at step S106. For example, as described in relation to FIG. 2, a thin film of powder of a sample material 38, such as strontium oxide powder, may be prepared and introduced into the vacuum chamber.

Preferably the sample treated to form an intermediate compound is strontium, however other metals, such as ytterbium, alkaline earth metals or alkali metals, can be used. Preferably the intermediate compound is strontium oxide, however other metal oxides or hydroxides, including alkaline earth metal and alkali metal oxides and hydroxides, can be used. Preferably the treatment of the sample involves exposure of strontium to air, however other methods to produce an intermediate compound, such as heating in a particular atmosphere, or exposure to a particular chemical or compound, can be used.

The invention claimed is:

1. A method of generating a vapour of neutral atoms of a specific species, the method comprising the steps of:

positioning a sample material comprising a compound of the specific species, in a vacuum; and irradiating the compound with a first laser, thereby to generate a vapour of neutral atoms of the specific species from the compound of the specific species, wherein the neutral atoms of the specific species in the vapour of neutral atoms of the specific species have a velocity of less than 50 $ms^{-1}$, and wherein a power output of the first laser is selected such that an intensity at the sample material is less than 4 $kW/cm^2$.

2. The method of claim 1, wherein the power output of the first laser is selected such that the irradiating step generates less thermal energy of the sample material than is required to evapourate or sublimate the sample material by heating.

3. The method of claim 1 comprising the step of adjusting the power of the first laser.

4. The method of claim 1 wherein the first laser is a continuous wave laser.

5. The method of claim 1, wherein the specific species is a metal.

6. The method of claim 5, wherein the metal is an alkaline earth metal or an alkali metal.

7. The method of claim 5, wherein the metal is beryllium, magnesium, calcium, strontium, barium, radium or ytterbium.

8. The method of claim 1, wherein the sample material is oxidised strontium.

9. The method of claim 1, wherein a material comprising the specific species is treated to form an intermediate compound and the intermediate compound is used as the compound of the specific species that is irradiated by the first laser.

10. The method of claim 5, wherein the compound is a metal oxide or hydroxide.

11. The method of claim 9 wherein strontium is treated to form strontium oxide and the strontium oxide is irradiated to generate a vapour of strontium atoms.

12. The method of claim 1, wherein the sample material is a powder, formed into a thin film, wherein the powder comprises particles with diameters in the range of 5 to 150 microns.

13. The method of claim 1, further comprising the steps of preparing the sample material, prior to the step of irradiating the compound, by mixing a powder with a solvent to form a paste;

spreading the paste onto a surface; and allowing the solvent to substantially evapourate, thereby to provide the sample material.

14. The method of claim 1, wherein the power output of the first laser is greater than 7 mW.

* * * * *